US010549879B2

(12) United States Patent
Palmer et al.

(10) Patent No.: US 10,549,879 B2
(45) **Date of Patent: *Feb. 4, 2020**

(54) CONTAINER AND METHOD OF MANUFACTURING THE SAME

(71) Applicants: Milacron LLC, Cincinnati, OH (US); Consolidated Container Company LP, Atlanta, GA (US)

(72) Inventors: Joey Palmer, Marietta, GA (US); James Janeczek, Tecumseh, MI (US); Robert Spagnoli, Cement City, MI (US)

(73) Assignees: Milacron LLC, Cincinnati, OH (US); Consolidated Container Company LP, Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/964,204

(22) Filed: Apr. 27, 2018

(65) Prior Publication Data

US 2018/0244423 A1 Aug. 30, 2018

Related U.S. Application Data

(63) Continuation of application No. 15/255,403, filed on Sep. 2, 2016, now Pat. No. 9,981,768.

(51) Int. Cl.
*B65D 1/42* (2006.01)
*B65D 23/10* (2006.01)
(Continued)

(52) U.S. Cl.
CPC ..... *B65D 1/42* (2013.01); *B65D 1/0207* (2013.01); *B65D 1/0246* (2013.01); *B65D 23/10* (2013.01);
(Continued)

(58) Field of Classification Search
CPC ..... B65D 1/42; B65D 1/0207; B65D 1/0246; B65D 23/10
(Continued)

(56) References Cited

U.S. PATENT DOCUMENTS 4,372,455 A 2/1983 Cochran
D348,612 S 7/1994 Ring
(Continued)

FOREIGN PATENT DOCUMENTS

WO WO 1998/033712 A1 8/1998

OTHER PUBLICATIONS

International Searching Authority, Invitation to Pay Additional Fees for Application No. PCT/US2017/047891, dated Nov. 2, 2017, 14 pages, European Patent Office, Netherlands.
(Continued)

*Primary Examiner* — Vishal Pancholi
(74) *Attorney, Agent, or Firm* — Alston & Bird LLP

(57) ABSTRACT

Various embodiments are directed to a container comprising: a spout, a base portion, and a plurality of alternating long sidewalls and short sidewalls extending away from the base portion to the spout. The plurality of alternating long sidewalls and short sidewalls collectively define a vertical portion extending away from the base portion, a downward sloping planar top portion extending away from the spout, and a gradually curved transition region extending between the vertical portion and the downward sloping planar top portion. The container comprises a strength protrusion surrounding the spout and defined within the downward sloping planar top portion and one or more vertical grooves defined within at least one of the long sidewalls or the short sidewalls.

19 Claims, 10 Drawing Sheets

(51) Int. Cl.

| | |
|---|---|
| ***B65D 1/02*** | (2006.01) |
| ***B65D 25/28*** | (2006.01) |
| ***B65D 25/42*** | (2006.01) |
| ***B65D 41/04*** | (2006.01) |

(52) U.S. Cl.
CPC ..... *B65D 25/2885* (2013.01); *B65D 25/42* (2013.01); *B65D 41/04* (2013.01)

(58) Field of Classification Search
USPC ..... 222/465.1, 572, 562, 107; 215/379, 215/381–384; 220/660, 669, 671–675
See application file for complete search history.

(56) References Cited

U.S. PATENT DOCUMENTS

| | | | | |
|---|---|---|---|---|
| 5,833,115 | A | 11/1998 | Eiten | |
| 6,068,161 | A | 5/2000 | Soehnlen et al. | |
| D427,076 | S | 6/2000 | Ankney et al. | |
| 6,237,792 | B1 | 5/2001 | Skolnicki et al. | |
| 6,527,133 | B1 | 3/2003 | McCollum et al. | |
| 6,588,612 | B1 * | 7/2003 | Dorn | B65D 1/18 206/509 |
| D485,497 | S | 1/2004 | Steele, IV et al. | |
| D488,721 | S | 4/2004 | Peronek | |
| 6,889,858 | B2 | 5/2005 | McCollum et al. | |
| 7,059,486 | B2 * | 6/2006 | Van Der Heijden | B65D 1/0223 215/379 |
| D593,863 | S | 6/2009 | Fahy et al. | |
| 7,699,171 | B2 | 4/2010 | Rivera et al. | |
| 8,047,392 | B2 | 11/2011 | Eiten et al. | |
| D662,421 | S | 6/2012 | Dorn | |
| D678,072 | S | 3/2013 | Lobbestael et al. | |
| 9,981,768 | B1 | 5/2018 | Palmer | |
| D823,690 | S | 7/2018 | Palmer et al. | |
| D823,691 | S | 7/2018 | Palmer et al. | |
| 2003/0006210 | A1 | 1/2003 | Iizuka et al. | |
| 2003/0155324 | A1 | 8/2003 | McCollum et al. | |
| 2004/0094502 | A1 | 5/2004 | Boukobza | |
| 2005/0082251 | A1 | 4/2005 | Darr et al. | |
| 2006/0260971 | A1 | 11/2006 | Rivera et al. | |
| 2007/0023384 | A1 | 2/2007 | Janeczek | |
| 2011/0132863 | A1 | 6/2011 | Dorn | |
| 2012/0241405 | A1 | 9/2012 | Lobbestael et al. | |
| 2013/0001234 | A1 | 1/2013 | Glover | |

OTHER PUBLICATIONS

International Searching Authority, International Search Report and Written Opinion for Application No. PCT/US2017/047891, dated Jan. 5, 2018, 21 pages, European Patent Office, Netherlands.
United States Patent and Trademark Office, Office Action for U.S. Appl. No. 15/255,403, dated Sep. 29, 2017.
United States Patent and Trademark Office, Notice of Allowance for U.S. Appl. No. 15/225,403, dated Mar. 5, 2018.
IP Australia, Australian Examination Report for Australian Application No. 2017320870, dated Jul. 19, 2019, (4 pages), Canberra, Australia.

* cited by examiner

CONTAINER AND METHOD OF MANUFACTURING THE SAME

CROSS-REFERENCE TO RELATED APPLICATIONS

This patent application is a continuation of U.S. application Ser. No. 15/255,403 filed Sep. 2, 2016, which is incorporated herein by reference in its entirety.

BACKGROUND

Containers that may be used to enclose and transport fluids are often subject to significant stresses during use. Such containers may be dropped while full or partially full of fluid, stacked on top of one another, supported in a suspended configuration (e.g., when held by a user), and/or the like. Accordingly, various containers incorporate various strengthening features in order to provide strength to the container against breakage.

However, various containers may be subject to additional limitations, such as a requirement to minimize the cost of materials in the containers, the weight of materials in the containers, and/or the like. Accordingly, container configurations often are subject to generally conflicting design considerations of maximizing the strength of the container while minimizing the cost and/or weight of materials in the container.

Accordingly, a need exists for containers providing an optimal balance of maximum strength against undesired breakage while minimizing the cost and/or weight of materials in the container.

BRIEF SUMMARY

Various embodiments are directed to a container comprising: a base portion configured to support the container in an upright orientation relative to a support surface and wherein the base portion defines an at least substantially octagonal perimeter; a spout positioned opposite the base portion and oriented such that a centerline of the spout is aligned with a centerline of the base portion; a plurality of alternating long sidewalls and short sidewalls extending between the perimeter of the base portion and the spout and having curved vertical transitions joining adjacent sidewalls, wherein the curved vertical transitions extend between the base portion and the spout, the plurality of alternating long sidewalls and short sidewalls collectively defining: a vertical portion extending away from the base portion; a downward sloping planar top portion extending away from the spout and toward the vertical portion; a gradually curved transition region extending between the vertical portion and the downward sloping planar top portion; and a strength protrusion surrounding the spout and defined within the downward sloping planar top portion; and one or more vertical grooves defined within at least one of the long sidewalls or the short sidewalls and extending within the vertical portion and the gradually curved transition region.

In various embodiments, the one or more vertical grooves comprise a plurality of vertical grooves comprising at least two vertical grooves having a first length and at least one vertical groove having a second length defined within a first short sidewalls, wherein the second length is longer than the third length. Moreover, the one or more vertical grooves may comprise at least one vertical groove having a third length defined within a second short sidewall, wherein the third length is longer than the second length.

In certain embodiments, each of the plurality of long sidewalls and short sidewalls defines an at least substantially uniform wall thickness through the vertical portion, transition region, and downward sloping planar top portion. Moreover, in certain embodiments, the plurality of alternating long sidewalls and short sidewalls additionally define a curved base transition region extending between the base portion and the vertical portion, wherein the curved base transition region encompasses one or more base vertical grooves. In certain embodiments, the one or more base vertical grooves are disposed within the one or more long sidewalls. As discussed herein, in certain embodiments, all of the long sidewalls have a first width and all of the short sidewalls have a second width, wherein the first width is longer than the second width.

In various embodiments, the container further comprises a handle portion comprising: a handle cavity defining a cavity surface extending across two of the long sidewalls and one of the short sidewalls; and a handle aligned with the one of the short sidewalls, wherein the handle defines a lower portion adjacent the portion of the one of the short sidewalls positioned within the vertical portion and an upper portion adjacent the spout. Moreover, at least a portion of an edge of the handle cavity may be aligned with at least one of the curved vertical transitions within the downward sloping planar top portion. At least a portion of the cavity surface may define a rough texture. Moreover, in certain embodiments, the handle has an acorn-shaped cross section.

In various embodiments, the strength protrusion defines a top surface positioned above the downward sloping planar top portion, and wherein the top surface of the strength protrusion is not planar with the downward sloping planar top portion. Moreover, the top surface of the strength protrusion may be curved.

In certain embodiments, the base portion defines: a first base channel extending across the base portion between a first short sidewall and a second short sidewall opposite the first short sidewall, wherein the first base channel defines a first depth; and a second base channel extending perpendicular to the first base channel across the base portion between a third short sidewall and a fourth short sidewall opposite the third short sidewall, wherein the second base channel defines a second depth; and wherein the first depth is deeper than the second depth. In various embodiments, the base portion defines a plurality of planar support surfaces each bound on a first side by the first base channel and bound on a second side by the second base channel. Moreover, in certain embodiments, the container is symmetrical about a container symmetry plane extending through the spout and the base portion and through a first short sidewall and a second short sidewall parallel to the first short sidewall.

Certain embodiments are directed to a container comprising: a base portion configured to support the container in an upright orientation relative to a support surface and wherein the base portion defines an at least substantially octagonal perimeter; a spout positioned opposite the base portion and oriented such that a centerline of the spout is aligned with a centerline of the base portion; a plurality of alternating long sidewalls and short sidewalls extending between the perimeter of the base portion and the spout and having curved vertical transitions joining adjacent sidewalls, wherein the curved vertical transitions extend between the base portion and the spout, the plurality of alternating long sidewalls and short sidewalls collectively defining: a vertical portion extending away from the base portion; a downward sloping planar top portion extending away from the spout and toward the vertical portion; and a gradually curved transition region extending between the vertical portion and the downward sloping planar top portion; and a plurality of vertical grooves defined within at least one of the long sidewalls or the short sidewalls and extending within the vertical portion and the gradually curved transition region, wherein the plurality of vertical grooves comprise: one or more first vertical grooves having a first length defined within a first short sidewall and a second short sidewall opposite the first short sidewall; one or more second vertical grooves having a second length defined within the first short sidewall and the second short sidewall, wherein the second length is longer than the first length; and one or more third vertical grooves having a third length defined within a third vertical sidewall, wherein the third length is longer than the second length. Moreover, in certain embodiments, the container is symmetrical about a container symmetry plane extending through the spout and the base portion and through the third short sidewall and a fourth short sidewall opposite the third short sidewall.

Certain embodiments are directed to a container comprising: a base portion configured to support the container in an upright orientation relative to a support surface and wherein the base portion defines an at least substantially octagonal perimeter; a spout positioned opposite the base portion and oriented such that a centerline of the spout is aligned with a centerline of the base portion; a plurality of alternating long sidewalls and short sidewalls extending between the perimeter of the base portion and the spout and having curved vertical transitions joining adjacent sidewalls, wherein the curved vertical transitions extend between the base portion and the spout, the plurality of alternating long sidewalls and short sidewalls collectively defining: a vertical portion extending away from the base portion; a downward sloping planar top portion extending away from the spout and toward the vertical portion; a gradually curved transition region extending between the vertical portion and the downward sloping planar top portion; a curved base transition region extending between the base portion and the vertical portion; and wherein the base portion defines: a first base channel extending across the base portion between a first short sidewall and a second short sidewall opposite the first short sidewall, wherein the first base channel defines a first depth; and a second base channel extending perpendicular to the first base channel across the base portion between a third short sidewall and a fourth short sidewall opposite the third short sidewall, wherein the second base channel defines a second depth; and wherein the first depth is deeper than the second depth. In certain embodiments, the base portion defines a plurality of planar support surfaces each bound on a first side by the first base channel, bound on a second side by the second base channel, and bound on a third side by the curved base transition region.

Yet other embodiments are directed to a container comprising: a base portion configured to support the container in an upright orientation relative to a support surface and wherein the base portion defines an at least substantially octagonal perimeter; a spout positioned opposite the base portion and oriented such that a centerline of the spout is aligned with a centerline of the base portion; a plurality of alternating long sidewalls and short sidewalls extending between the perimeter of the base portion and the spout and having curved vertical transitions joining adjacent sidewalls, wherein the curved vertical transitions extend between the base portion and the spout, the plurality of alternating long sidewalls and short sidewalls collectively defining: a vertical portion extending away from the base portion; a downward sloping planar top portion extending away from the spout and toward the vertical portion; a gradually curved transition region extending between the vertical portion and the downward sloping planar top portion; a curved base transition region extending between the base portion and the vertical portion; and a handle portion positioned at least partially within the vertical portion, the downward sloping planar top portion, and the gradually curved transition region, wherein the handle portion comprises: a cavity surface extending across a first long sidewall, a second long sidewall, and a first short sidewall positioned between the first long sidewall and the second long sidewall, wherein at least a portion of a perimeter of the cavity surface is aligned with one or more curved vertical transitions within the downward sloping planar top portion; and a handle aligned with the first short sidewall, wherein the handle defines a lower portion adjacent the portion of the one of the short sidewalls positioned within the vertical portion and an upper portion adjacent the spout. In certain embodiments, the cavity surface defines an inset upper cavity surface and a lower cavity surface; the inset upper cavity surface may extend across the first long sidewall, the second long sidewall, and the first short sidewall, and at least a portion of a perimeter of the upper cavity surface may be aligned with the one or more curved vertical transitions within the downward sloping planar top portion; wherein the lower cavity surface extends between the inset upper cavity surface and vertical portions of the first long sidewall and the second long sidewall; and wherein the lower cavity surface forms an obtuse angle with the inset upper cavity surface. Moreover, at least a portion of the handle may be spaced apart from the inset upper cavity surface; and the handle portion may define a handle rib extending along the handle, the inset upper cavity surface, and the lower cavity surface.

BRIEF DESCRIPTION OF THE SEVERAL VIEWS OF THE DRAWINGS

Reference will now be made to the accompanying drawings, which are not necessarily drawn to scale, and wherein.

DETAILED DESCRIPTION

Figure 1:
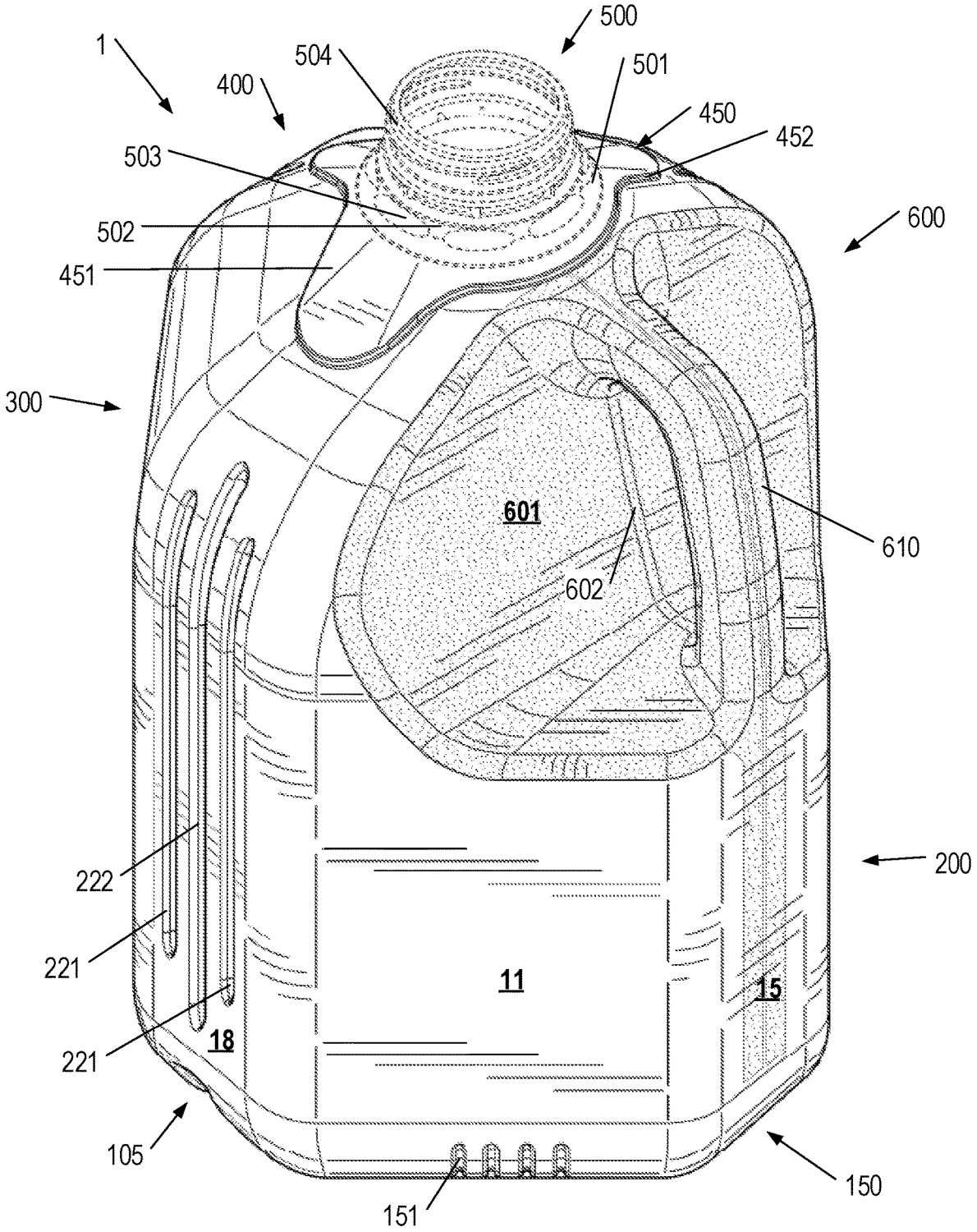
FIGS. 1-8 show various perspective views of a container according to various embodiments.

The present invention will now be described more fully hereinafter with reference to the accompanying drawings, in which some, but not all embodiments of the invention are shown. Indeed, the invention may be embodied in many different forms and should not be construed as limited to the embodiments set forth herein. Rather, these embodiments are provided so that this disclosure will satisfy applicable legal requirements. Like numbers refer to like elements throughout.

Overview

Described herein is a container configured to enclose a fluid and/or other substance. The container comprises a plurality of strengthening features that provide desirable strength characteristics while minimizing the required amount of material necessary to construct the container having the desired strength characteristics. For example, various strengthening features may comprise one or more ribs, grooves, raised features, and/or the like, that may extend across planar surfaces, curved surfaces, and/or complex curved surfaces in order to provide crush resistance, tensile strength, and/or the like for the container. In various embodiments, the container may comprise a plastic material (e.g., High-Density Polyethylene (HDPE)). As a non-limiting example, the container may comprise at least about 52-72 g of material to provide a container having an interior volume of at least substantially 1 gallon; substantially larger or smaller containers may be formed or provided, with structural features beyond size/dimension otherwise as detailed herein.

As discussed herein, the container may define an at least substantially octagonal base-perimeter having a plurality of alternating short sidewalls and a plurality of long sidewalls. In certain embodiments, the short sidewalls may share a first sidewall length and the long sidewalls may share a second sidewall length. The plurality of sidewalls may extend from a base portion (e.g., from a base transition region), through a vertical region, through a top transition region, through a top region, and to a spout. In various embodiments, the container may additionally define a handle portion encompassing a portion of a subset of the sidewalls. The handle portion may be defined as a handle cavity and a handle, thereby providing a portion enabling a user to comfortably hold the container.

The container may be extrusion blow-molded. In various embodiments, the container may be constructed by placing (e.g., injecting) a parison within a container mold having an interior surface corresponding to the shape of the container. In various embodiments, the container mold may comprise two mold shells that collectively define the entirety of the mold. The mold shells may be symmetrical and have corresponding features, and accordingly the resulting container may be symmetrical across one or more planes.

As discussed herein, for purposes of clarity, the following description of a container is divided into various portions of the container, however it should be understood that such divisions should not construed as limiting, as one or more containers according to various embodiments may be constructed as a single continuous part. Moreover, the following description provides various dimensions for an example embodiment. These dimensions should not be construed as limiting, and are instead provided as example dimensions an example embodiment.

Container Construction

In various embodiments, the container 1 may comprise an at least semi-rigid material. Semi-rigid containers 1 may be configured to flex when exposed to externally applied forces, and/or rigid containers 1 may be configured to resist substantial flexing when subject to externally applied forces. For example, the container 1 may comprise plastic, metal, and/or the like. As just one specific example, the container 1 may comprise HDPE. As will be discussed herein, the container may be extrusion blow-molded. In such embodiments, the container 1 may comprise at least approximately 52-72 g of material to provide a 1-gallon interior volume container. As other example embodiments, the container 1 may comprise at least approximately 32-38 g of material for a ½-gallon interior volume container, and/or at least approximately 23-29 g of material for a 1-quart interior volume container.

Except as otherwise discussed herein, the container 1 may have an at least substantially uniform wall thickness (extending between the interior of the container 1 and the exterior surface of the container 1) of at least approximately 0.007-0.011 inches (e.g., 0.009 inches). Accordingly, each sidewall may have an at least substantially uniform wall thickness between the vertical portion 200, top transition region 300, and top portions 400 (each described in greater detail herein). In various embodiments, the container 1 may be configured to resist a vertical crushing force of at least approximately 30 lbf of force with about a ¼" deflection in overall height of the bottle when filled and having a cap secured onto a spout thereof before breaking. Moreover, the container 1 may be configured to fall from a height of at least approximately 2 feet onto a hard surface without breaking.

Figure 7:
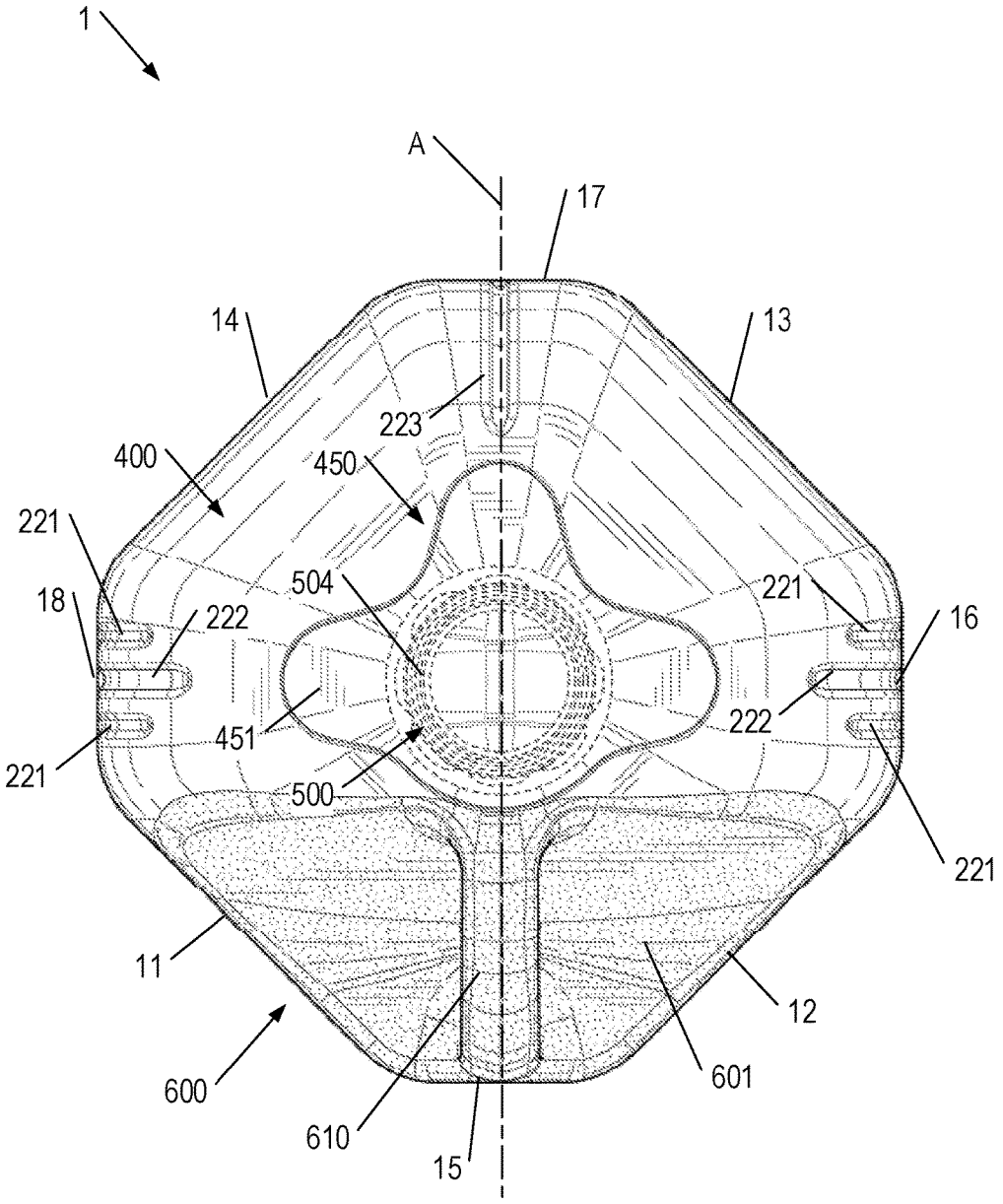
Figure 8:
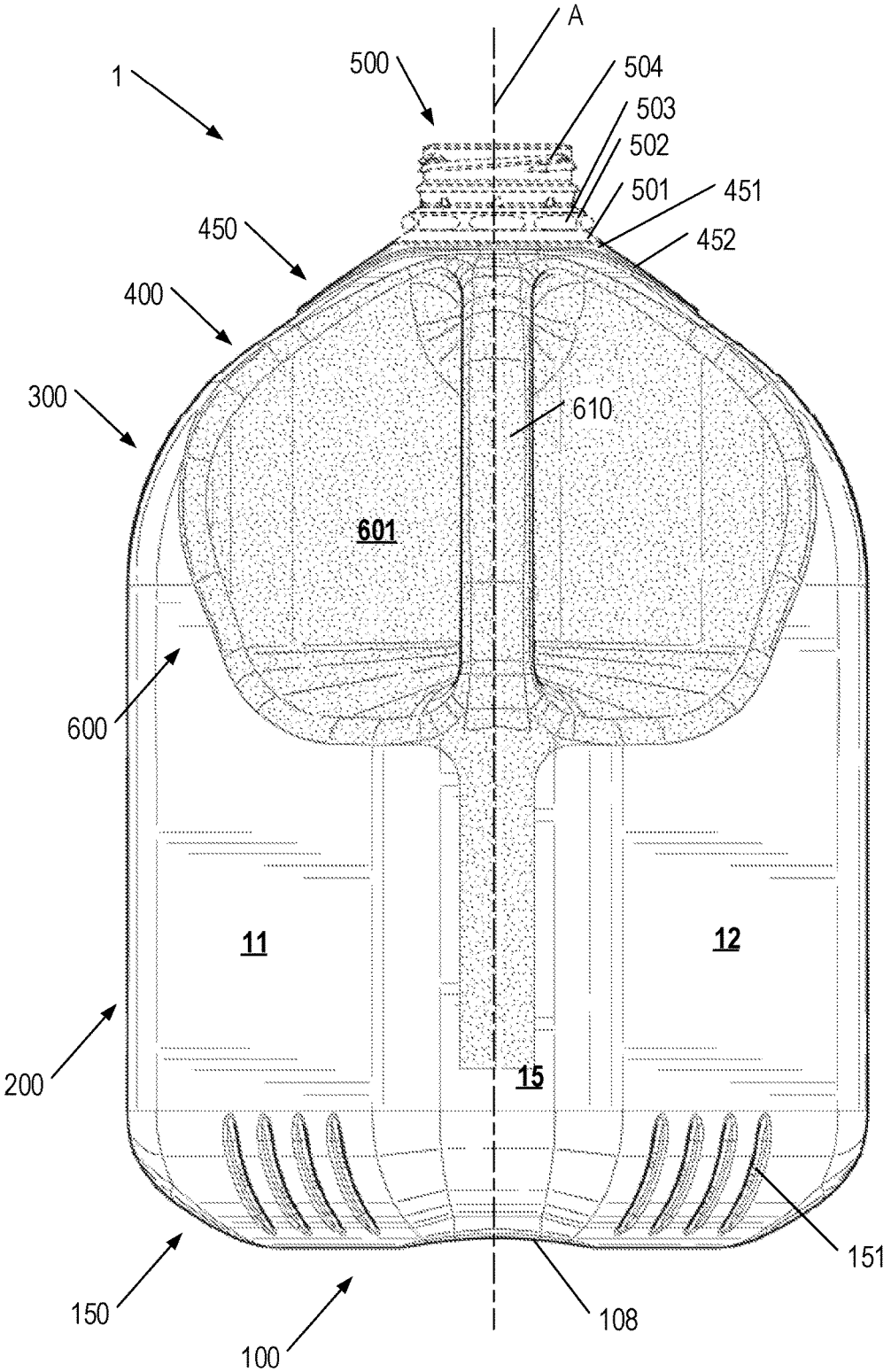

As will be discussed herein with reference to specific contours of the container 1, the container 1 may define a symmetry plane A extending through the center of the container. In various embodiments, the container may be symmetrical about the symmetry plane A, such that contours on a first side of the symmetry plane A are equal and opposite to contours on a second side of the symmetry plane A. As illustrated in FIGS. 7-8, the symmetry plane A may extend through a center of a handle portion 600, spout 500 and through opposite short sidewalls 15-18.

Base Portion 100

Figure 2:
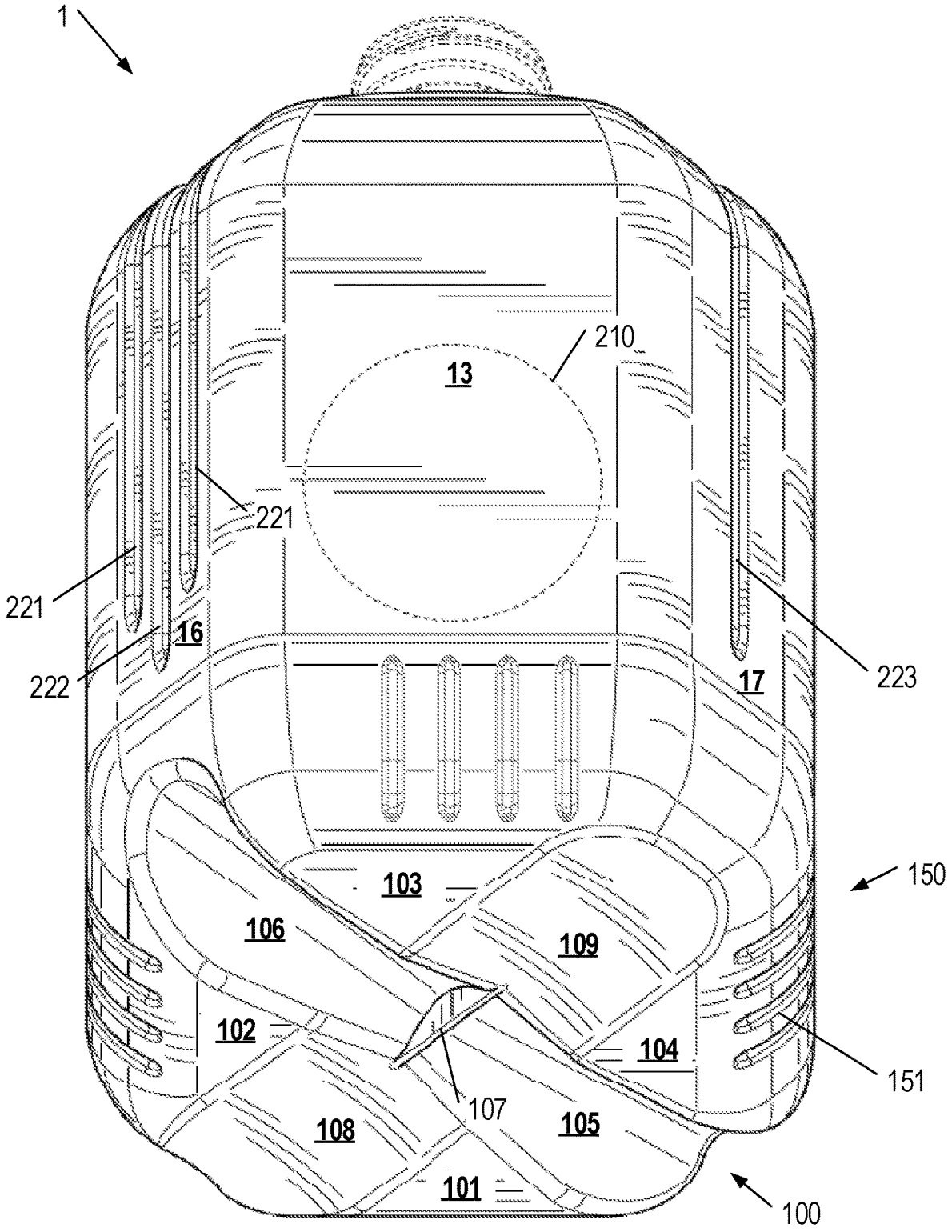
Figure 3:
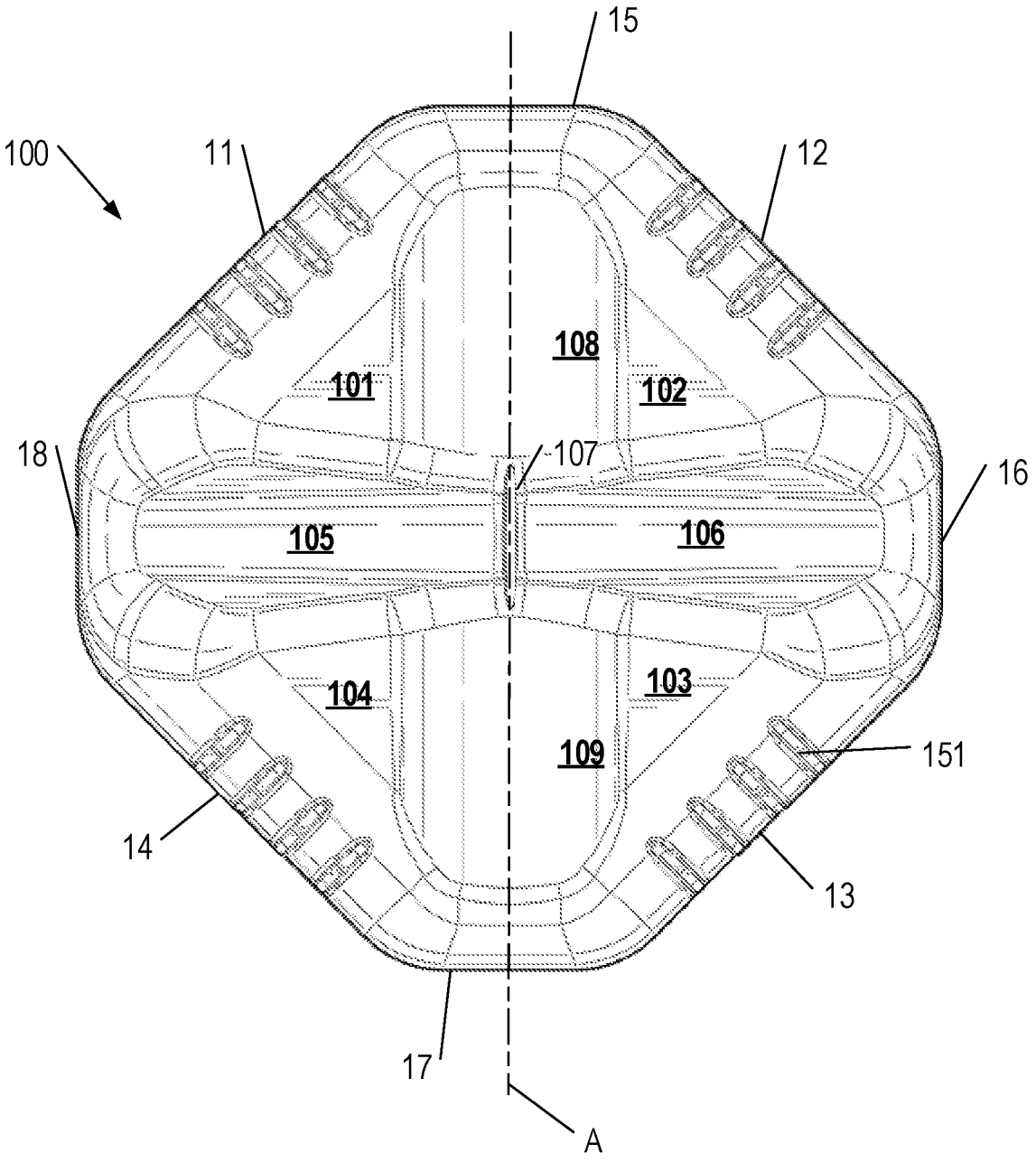
Figure 4:
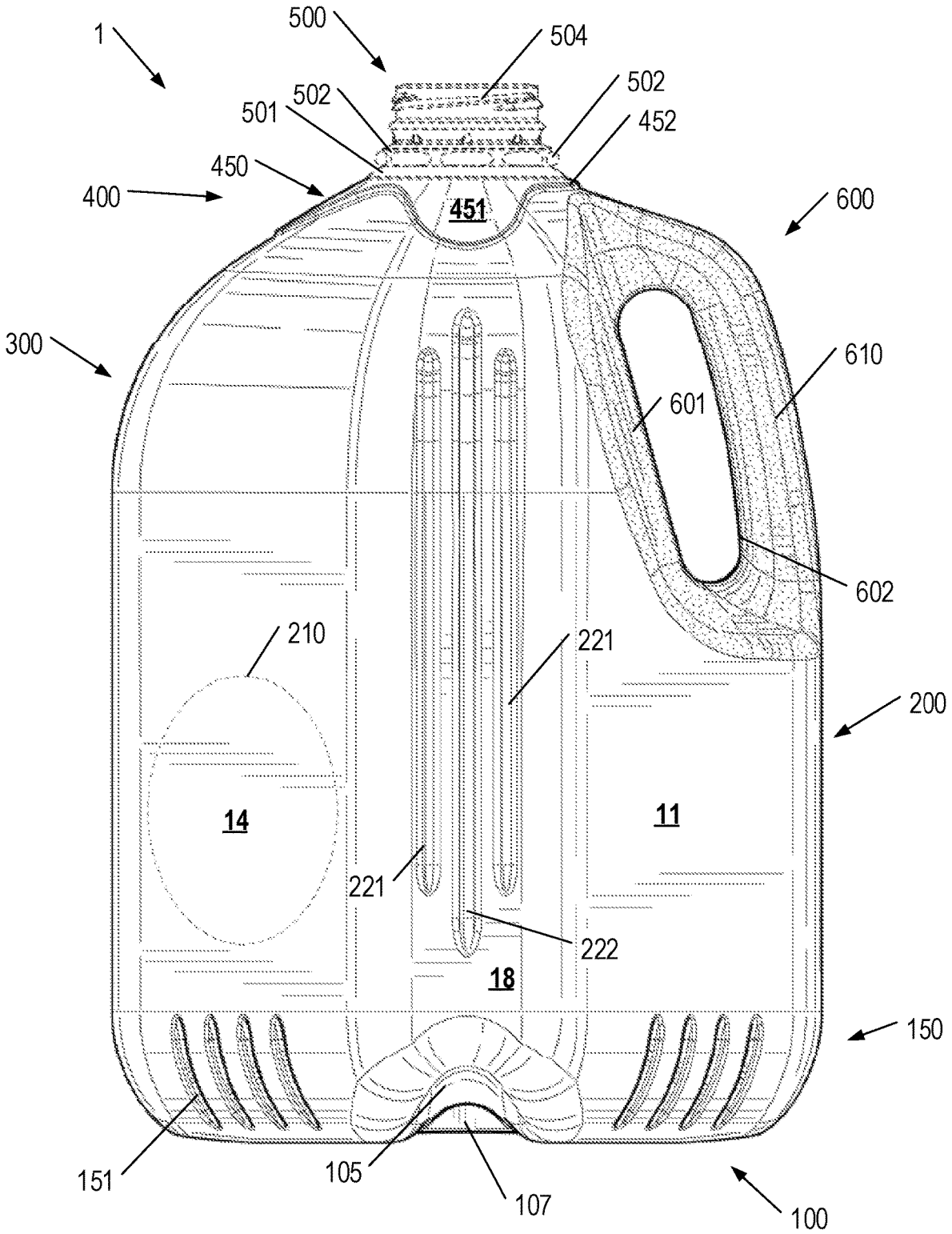
Figure 5:
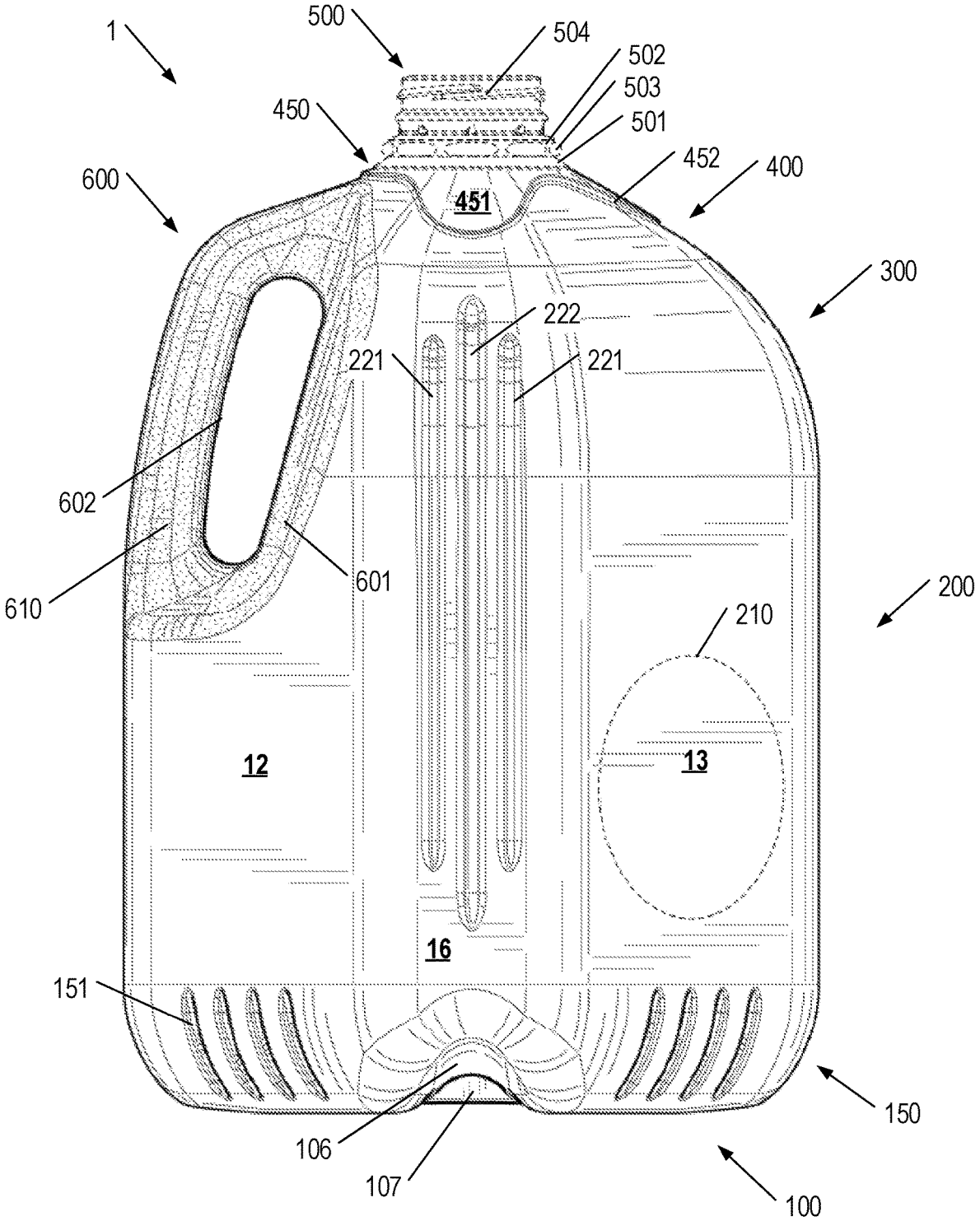
Figure 6:
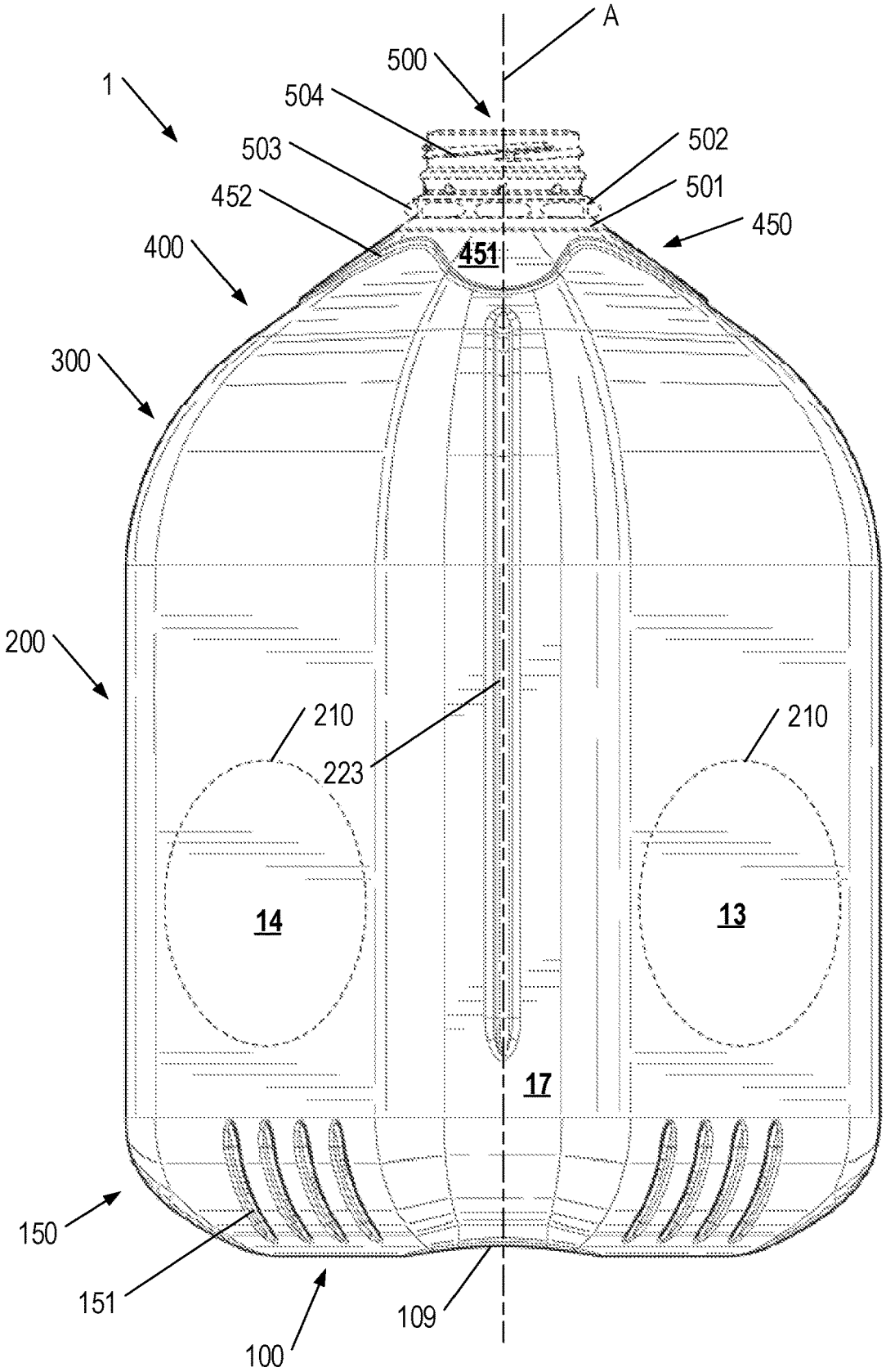

As illustrated in FIGS. 1-8, a container 1 according to various embodiments may be supported in an upright configuration by a base portion 100 relative to a support surface. With reference specifically to FIGS. 2-3, the base portion 100 defines a plurality of surface contours configured to provide strength to a bottom portion of the container 1. Before discussing the configuration of each of the surface contours of the base portion 100, the illustrated embodiments of FIGS. 1-8 show one embodiment of a container 1 defining an octagonal perimeter (as visible most clearly from FIGS. 3 and 7, which show the bottom and top views of the container 1, respectively). As shown in FIGS. 3 and 7, the container 1 may define a plurality of alternating long sidewalls 11-14 and short sidewalls 15-18. As will be discussed in greater detail herein, the plurality of long sidewalls 11-14 may share a first sidewall width (e.g., 2.63-2.79 inches), and the plurality of short sidewalls 15-18 may share a second sidewall width (e.g., 1.00-1.12 inches), wherein the first sidewall width is longer than the second sidewall width. However, it should be noted that the long sidewalls 11-14 may define one or more sidewall widths (e.g., parallel and opposite sidewall pairs may each define corresponding sidewall widths different from other sidewall widths). Similarly, the short sidewalls 15-18 may define one or more sidewall widths.

With reference again to the various contours of the base portion 100, the base portion 100 may be defined between a base transition region 150 extending around the perimeter of the container 1. In various embodiments, the base transition region 150 may define an at least substantially continuous radius around the entire perimeter of the container 1 (with exceptions, for example, resulting from the presence of one or more channels extending through the base transition region) extending between the base portion 100 and the container sidewalls 11-18. As just one non-limiting example, the base transition region may have a radius of at least approximately 1.35-1.4 inches (e.g., 1.375 inches). In various embodiments, the base transition region 150 may define one or more base transition grooves 151 following the length of the radius of the base transition region 150. In the illustrated embodiment of FIGS. 1-8, the base transition grooves 151 may extend between the long sidewalls 11-14 and one or more support surfaces 101-104 (as discussed herein). The base transition grooves 151 may have a rounded depth profile having a radius of at least approximately 0.05-0.06 inches (e.g., 0.055 inches). The base transition grooves 151 may have a depth (to the deepest portion of the groove) of at least approximately 0.04-0.06 inches (e.g., 0.05 inches). The base transition grooves 151 may each have an at least substantially uniform depth along the respective lengths of the base transition grooves 151. Moreover, the grooves 151 may have a curved transition from the base transition region 150 into the base transition grooves having a radius of at least approximately 0.05-0.06 inches (e.g., 0.055 inches). In various embodiments, the grooves 151 may have sidewalls extending between the curved transition region to the depth profile radius at an angle relative to a symmetry line of the groove 151 of at least approximately 40-60 degrees (e.g., 50 degrees).

In the illustrated embodiments of FIGS. 1-8, the base transition grooves 151 may have an equal length of at least approximately 1.04-1.1 inches (e.g., 1.07 inches) (extending between the support surfaces 101-104 to the long sidewalls 11-14. However, it should be understood that various base transition grooves 151 may have lengths, depths, and/or other configurations different from other base transition grooves 151. In the illustrated embodiment of FIGS. 1-8, four base transition grooves 151 extend between each support surface 101-104 and the corresponding long sidewall 11-14, for a total of 16 base transition grooves 151 defined in the container. However, it should be understood that more or less base transition grooves may be present in various embodiments.

In the illustrated embodiment of FIG. 3, the base portion 100 defines one or more support surfaces 101-104. In the illustrated embodiment, the one or more support surfaces 101-104 may each be at least substantially planar and may all substantially reside in a single plane (e.g., at least substantially perpendicular to the one or more sidewalls 11-18), thereby defining a planar support on which the container 1 is supported in the upright configuration. In various embodiments, the support surfaces 101-104 may define the bottom-most plane of the container 1, such that other contours present in the base portion 100 may extend upward and inward toward the interior of the container 1.

In various embodiments, the one or more support surfaces 101-104 may be positioned proximate one or more long sidewalls of the container 11-14, between one or more first channel portions 105-106 and one or more second channel portions 108-109, which may respectively extend between parallel pairs of short sidewalls 15-18. In various embodiments, the support surfaces 101-104 may each define an at least substantially triangular profile, bounded on a first side by the base transition region 150 extending to respective long sidewalls 11-14, bounded on a second side by first channel portions 105-106, and bounded on a third side by second channel portions 108-109. In the illustrated embodiment of FIG. 3, the base portion 100 defines four support surfaces 101-104, although various embodiments may define more or less than four support surfaces 101-104. For example, various embodiments may define three support surfaces or five or more support surfaces to provide a stable support on which the container 1 resides when in the upright configuration.

Moreover, in the illustrated embodiment of FIG. 3, the base portion 100 defines a first channel extending between parallel and opposite short sidewalls 15-18. The first channel may be embodied as a first channel portions 105-106 having corresponding symmetrical configurations about the container symmetry plane A. Moreover, in various embodiments, each first channel portion 105-106 may be individually symmetrical about a plane perpendicular to the container symmetry plane A. Each first channel portion 105-106 may extend from an outside edge proximate a corresponding short sidewall 15-18 along a length of the first channel portion 105-106 toward a center of the base portion 100 (e.g., toward the container symmetry plane A). The first channel portions 105-106 may have an at least substantially equal depth (measured in a direction toward the interior of the container 1) along the length of the first channel portions 105-106, however, in certain embodiments, the depth of the first channel portions 105-106 may vary between the outside edge and the center of the base portion 100. For example, the first channel portions 105-106 may have a decreasing depth from the outside edge toward the center of the base portion 100. As a specific example, the first channel portions 105-106 may have a depth of at least approximately 0.7-0.8 inches (e.g., 0.75 inches) at an outside edge and a linearly decreasing depth to a depth of at least approximately 0.3-0.4 inches (e.g., 0.36 inches) at a center portion of the base portion 100. Moreover, the first channel portions 105-106 may have an at least substantially equal width between the outside edge and the center portion of the base portion 100. The width of the first channel portions 105-106 may be defined between the outermost edges of the transition region between the support surfaces 101-104 and the first channel portions 105-106. However, in certain embodiments, the first channel portions 105-106 may have a varying width along the length of the first channel portions 105-106. For example, in the illustrated embodiment of FIG. 3, the first channel portions 105-106 may have a decreasing (e.g., linearly decreasing) width between the outside edge and the center portion of the base portion 100.

Moreover, in various embodiments, the first channel portion 105-106 may have a curved interior surface (e.g., defining the depth of the first channel portion 105-106) having a radius of at least about 0.4-0.5 inches (e.g., 0.44 inches). As shown in the illustrated embodiment of FIG. 3, the first channel portion 105-106 may interrupt the continuous radius of the base transition region 150, and may occupy at least substantially the entire width of the corresponding short sidewalls 15-18, and may therefore transition directly to the corresponding short sidewalls 15-18. As noted above, the first channel portions 105-106 may define at least one boundary of each of the one or more support surfaces 101-104. In the illustrated embodiment of FIG. 3, the boundary between the support surfaces 101-104 and the first channel portions 105-106 may be a smooth curve having a radius of at least about 0.35-0.475 inches. In various embodiments, the radius of curvature may vary along the length of the first channel portions 105-106, for example, between at least approximately 0.375-0.450 inches. Finally, as shown in FIG. 3, the first channel portions 105-106 may be separated at the center portion of the base portion 100 by a support tab 107. The support tab may extend away from an interior depth of the first channel and may entirely fill first channel at the center portion of the base portion 100 having a width of between about 0.375 inches and 0.5 inches. In various embodiments, the width of the first channel may vary, for example, between about 0.375 inches and 0.5 inches. As discussed herein, a shallow, second channel may extend across the base portion 100 between second short sidewalls 15-18, perpendicular to the first channel, and accordingly the support tab may extend between a depth of the first channel and a depth of the second channel, wherein the depth of the second channel is shallower than the depth of the first channel. In various embodiments, the support tab 107, may be parallel to the container symmetry plane A, and may be aligned such that the central plane of the support tab 107 is coplanar with the container symmetry plane A.

In various embodiments, the mentioned second channel portions 108-109 may extend between parallel and opposite short sidewalls 15-18 and may be perpendicular to the first channel. As discussed herein, the second channel may have a depth shallower than the depth of the first channel (measured toward the interior of the container). The second channel portions 108-109 may extend between an outside edge and a center portion of the base portion 100. Because the deeper first channel intersects the second channel, the second channel portions 108-109 may be positioned on opposite sides of the first channel. In various embodiments, the second channel portions 108-109 may be symmetrical across the first channel. Moreover, as discussed herein, each second channel portion 108-109 may be individually symmetrical about the container symmetry plane A.

In the illustrated embodiment of FIG. 3, the second channel may not substantially interrupt the base transition region 150, and accordingly, the second channel portions 108-109 may be bound by the base transition region 150, the support surfaces 101-104, and the first channel. In various embodiments, the second channel portions 108-109 may have an at least substantially equal depth along the length of the second channel portions 108-109 between the outer portion (defined by the boundary with the base transition region 150) and the center portion of the base portion 100 (defined by the boundary with the first channel). However, in certain embodiments, the depth of the second channel portions 108-109 may vary (e.g., linearly decrease) between the outer portion and the center portion. As a specific example, the second channel portions 108-109 may have a continuous and/or decreasing depth of at least approximately 0.05-0.13 inches (e.g., 0.09 inches).

Similarly, the second channel portions 108-109 may have an equal width (e.g., defined between the outermost boundaries of a transition region between the support surfaces 101-104 and the second channel portions 108-109) along the length of the second channel portions 108-109. However, in certain embodiments, the second channel portions 108-109 may have a varying (e.g., linearly decreasing) width along the length of the second channel portions 108-109 between the outer edge and the center portion. For example, in the illustrated embodiment of FIG. 3, the second channel portions 108-109 may have a continuous and/or decreasing width of at least approximately 0.17-0.18 inches (e.g., 1.75 inches). In various embodiments, the outer edge of the second channel portions 108-109 may occupy at least substantially the entire width of the corresponding short sidewalls 15-18.

Moreover, the second channel portions 108-109 may define a curved interior surface (e.g., defining the depth of the second channel portions 108-109) having a radius of at least about 4.2-4.4 inches (e.g., 4.3 inches). As discussed herein, the second channel portions 108-109 may not substantially interrupt the base transition region 150, and accordingly the second channel portions 108-109 may define a transition region between the interior of the second channel portions 108-109 and the transition region 150.

Although discussed herein as the first channel comprising first channel portions 105-106 that are symmetrical across the container symmetry plane A and the second channel comprising second channel portions 108-109 extending perpendicular to the container symmetry plane A, it should be understood that in various embodiments, the contours of the base portion 100 may be rotated, such that the second channel portions 108-109 are symmetrical across the container symmetry plane A, the first channel portions 108-109 extend along lengths parallel to the container symmetry plane A and are symmetrical across a plane perpendicular to the container symmetry plane A, and the support tab 107 is perpendicular to the container symmetry plane A.

Vertical Portion 200

In the illustrated embodiment of FIGS. 1-8, the container 1 defines a vertical portion 200 extending between the base transition region 150 and the top transition region 300. The vertical portion 200 may be defined by portions of the sidewalls 11-18 having an at least substantially vertical orientation (while the container is in the upright configuration). Accordingly, the vertical portion 200 may comprise vertical portions of the one or more long sidewalls 11-14 and vertical portions of the one or more short sidewalls 15-18. As shown in the illustrated embodiments of FIGS. 1-8, the vertical portions of each of the one or more long sidewalls 11-14 and the one or more short sidewalls 15-18 may reside at least substantially within corresponding planes. As previously indicated, the container 1 may have an at least substantially octagonal profile, and accordingly the planes corresponding to the vertical portions of the sidewalls 11-18 may be oriented to form an at least substantially octagonal shape. Moreover, each of the planes corresponding to the vertical portions of the sidewalls 11-18 may be at least substantially perpendicular to the plane corresponding to the one or more support surfaces 101-104 of the base portion 100.

In various embodiments, the vertical portions of the one or more sidewalls 11-18 may be at least substantially planar, and may define vertical transitions between adjacent sidewalls. The vertical transitions may be curved surfaces having a radius of at least approximately 0.3-0.4 inches (e.g., 0.36 inches). In various embodiments, the vertical transitions may each extend along the height of the vertical portion 200, through the top transition region 300, and through the top portion 400. In certain embodiments, the vertical transitions may each define an at least substantially continuous radius along the length of the vertical transitions. However, in certain embodiments, the radius of curvature of the vertical transitions may change along the length of the vertical transitions. For example, the vertical transitions may define a first radius of curvature in the vertical portion 200, a second radius of curvature in the top transition region 300, and a third radius of curvature in the top portion 400. In various embodiments, the vertical transitions may each define two different radii of curvature. Accordingly, the radius of curvature of the vertical transitions in the vertical portion 200 may be the same as the radius of curvature of the vertical transitions in the top transition region 300 or the top portion 400. As yet another example embodiment, the radius of curvature of the vertical transitions in the top transition region 300 may be the same as the radius of curvature of the vertical transitions in the top portion 400. In various embodiments, all of the vertical transitions may have at least substantially uniform characteristics between the vertical transitions. For example, each vertical transition may define a first radius of curvature and curve length within the vertical portion 200, a second radius of curvature and curve length within the top transition region 300, and a third radius of curvature and curve length within the top portion 400.

Referring again to the vertical portion 200, the planar portions of the one or more long sidewalls 11-14 may have a width (extending between vertical transitions bounding each long sidewall) of at least approximately 2.63-2.79 inches, and a height (extending between the base transition region 150 and the top transition region 300) of at least approximately 4.6-4.8 inches (e.g., 4.7 inches). However, as will be discussed in greater detail herein, a subset of the long sidewalls 11-14 may be interrupted by the handle portion 600, and accordingly, the interrupted long sidewalls 11-14 may define a planar portion having an interrupted height (extending between the base transition region 150 and the bottom edge of the handle portion 600) of at least approximately 3.16-3.20 inches (e.g., 3.18 inches).

The planar portions of the one or more short sidewalls 15-18 may have a width (extending between vertical transitions bounding each short sidewall) of at least approximately 1.00-1.12 inches, and a height (extending between the base transition region 150 and the top transition region 300) of at least approximately 4.6-4.8 inches (e.g., 4.7 inches). However, as will be discussed in greater detail herein, a subset of the short sidewalls 15-18 (e.g., one short sidewall) may be interrupted by the handle portion 600, and accordingly, the interrupted short sidewalls 15-18 may define a planar portion having an interrupted height (extending between the base transition region 150 and the bottom edge of the handle portion 600) of at least approximately 3.16-3.2 inches (e.g., 3.18 inches).

In the illustrated embodiment of FIGS. 1-8, one or more of the vertical portions of the sidewalls 11-18 may define one or more volume control features 210. The volume control features 210 may each define a protrusion extending away from the interior of the container 1 within the corresponding vertical portion of a sidewall, or a cavity extending toward the interior of container 1 within the corresponding vertical portion of a sidewall. Accordingly, a protruding volume control feature 210 may provide additional interior volume of the container 1, and a cavernous volume control feature 210 may decrease the interior volume of the container 1. In the illustrated embodiment of FIGS. 1-8, the volume control features 210 may be circular, however the volume control features may be any of a variety of shapes, such as triangular, ovular, rectangular, octagonal, and/or the like. In various embodiments, the volume control features 210 may be defined within long sidewalls 11-14, however it should be understood that various volume control features 210 may be defined in certain short sidewalls 15-18. Moreover, in the illustrated embodiment of FIGS. 1-8, a single volume control feature 210 is defined within a single corresponding sidewall, however it should be understood that a variety of volume control features may be defined in a single corresponding sidewall.

In various embodiments, one or more grooves may be defined within one or more sidewalls. For example, in the illustrated embodiment of FIGS. 1-8, one or more grooves may be defined within respective short sidewalls 15-18, extending parallel to the height of the short sidewalls 15-18 within the vertical portion 200 and/or the top transition region 300. The one or more grooves may provide increased vertical crush resistance to the container.

Specifically, one or more sidewalls may comprise one or more first grooves 221 and/or one or more second grooves 222. For example, in the illustrated embodiment of FIGS. 1-8, a short sidewall 15-18 may comprise a single second groove 222 extending along a vertical center-line of the short sidewall, and two first grooves 221 positioned on opposite sides of the single second groove 222. In various embodiments, the one or more first grooves 221 may be spaced a distance from the second groove 222. For example, the one or more first grooves 221 may be 0.08-0.14 inches (e.g., 0.11 inches) away from the second groove 222 (measured between an outermost vertical edge of a transition region between each first groove 221 and the sidewall 15-18 and the immediately adjacent outermost vertical edge of the second groove 222).

In various embodiments, the one or more first grooves 221 may have a length (measured parallel to the height of the short sidewalls 15-18 between a bottom-most point of a transition between the first grooves 221 and a portion of the short sidewall 15-18 and a top-most point of a transition between the first grooves 221 and a portion of the short sidewall 15-18) shorter than a length of the one or more second grooves 222. In the illustrated embodiment, the one or more first grooves 221 may have a length of at least approximately 5.0-5.2 inches (e.g., 5.10 inches), and the one or more second grooves may have a length of at least approximately 5.95-6.15 inches (e.g., 6.05 inches). However, in various embodiments, the one or more first grooves 221 may have a length equal to the length of the one or more second grooves 222. In various embodiments, a centerline of each of the first grooves 221 (perpendicular to the length of the first grooves 221) may align with a corresponding centerline of the second groove 222 (perpendicular to the length of the second groove 222).

In various embodiments, the one or more first grooves 221 may have an at least substantially continuous depth (e.g., measured between the surface of the sidewall in which the first grooves 221 are disposed and an innermost surface of the first grooves 221 positioned toward the interior of the container 1) along the length of the first grooves 221. Moreover, the first grooves 221 may have a rounded inner surface having an at least substantially continuous radius. The first grooves 221 may have a continuous width along the length of the first grooves 221. Finally, the first grooves 221 may have a transition radius between the corresponding sidewall and the first grooves 221. As just one, non-limiting configuration, the first grooves 221 may have a depth of at least about 0.03-0.05 inches (e.g., 0.04 inches), a sidewall angle relative to a symmetry line of the first grooves of at least about 95-105 degrees (e.g., 100 degrees), an inner surface radius of at least approximately 0.07-0.08 inches (e.g., 0.075 inches), and a transition radius of at least approximately 0.05-0.15 inches (e.g., 0.10 inches). However, it should be understood that in various embodiments, the depth, width, inner surface radius, and/or transition radius may vary along the length of the first grooves 221.

In various embodiments, the second grooves 222 may have a depth, width, inner surface radius, and/or transition radius at least substantially the same as the first grooves 221. However, in certain embodiments, the second grooves 222 may have a depth, width, inner surface radius, and/or transition radius different from the first grooves. For example, the second grooves may have a depth of at least about 0.05-0.07 inches (e.g., 0.06 inches), a sidewall angle relative to a symmetrical line of the first grooves of at least about 95-105 degrees (e.g., 100 degrees), an inner surface radius of at least about 0.1-0.14 inches (e.g., 0.12 inches), and a transition radius of at least about 0.10 inches. In various embodiments, the depth, width, inner surface radius, and/or transition radius of the second grooves 222 may be consistent along the length of the second grooves 222. However, in various embodiments, the depth, width, inner surface radius, and/or transition radius of the second grooves 222 may vary along the length of the second grooves 222.

Finally, in various embodiments, one or more sidewalls may define a third groove 223. In various embodiments, the third groove may have characteristics corresponding to those of either the first grooves 221 and/or the second grooves 222. However, in certain embodiments, the third grooves may have a length of at least about 6.5-6.7 inches (e.g., 6.6 inches), a depth of at least about 0.05-0.07 inches (e.g., 0.06 inches), a sidewall angle relative to a symmetrical line of the first grooves of at least about 95-115 degrees (e.g., 110 degrees), an inner surface radius of at least about 0.115-0.135 inches (e.g., 0.125 inches), and a transition radius of at least about 0.115-0.135 inches (e.g., 0.125 inches).

In the illustrated embodiment of FIGS. 1-8, a first short sidewall 15-18 may define a single second groove 222 and two first grooves 221 positioned on opposite sides of the second groove 222. A second short sidewall 15-18 parallel and opposite the first short sidewall may define a symmetrical configuration of a single second groove 222 and two first grooves 221 positioned on opposite sides of the second groove 222. In various embodiments, the first short sidewall 15-18 may be positioned across the container symmetry plane A from the second short sidewall 15-18, and accordingly the configuration of the first short sidewall 15-18 may be symmetrical with the second short sidewall 15-18.

Moreover, in the illustrated embodiment of FIGS. 1-8, a third short sidewall 15-18 may define a third groove 223 therein. In the illustrated embodiment, the third groove 223 may extend along a vertical centerline of the third short sidewall 15-18, and the centerline of the third groove 223 (and the third short sidewall 15-18) may align with the container symmetry plane A. As discussed in greater detail herein, the third short sidewall 15-18 may be parallel and opposite a fourth short sidewall 15-18, which may be interrupted by the handle portion 600. In various embodiments, the fourth short sidewall 15-18 may be planar, and may not define a groove therein. In various embodiments, at least a portion of the fourth short sidewall 15-18 may have a rough surface texture.

Various configurations of grooves and/or volume control features may be provided. For example, the one or more short sidewalls 15-18 parallel to the container symmetry plane A may each define a single groove (e.g., third groove 223) therein having a configuration as described above, and the short sidewall 15-18 divided by the container symmetry plane A may define a plurality of grooves (e.g., two first grooves 221 and/or a single second groove 222) as discussed herein. In certain embodiments, one or more long sidewalls 11-14 may define one or more grooves.

Top Transition Region 300

In the illustrated embodiment of FIGS. 1-8 the top transition region 300 may be defined between the vertical portion 200 and the top portion 400, and may thereby define the transition between the planar portions of the sidewalls 11-18 within the vertical portion 200, and the planar, non-vertical portions of the sidewalls 11-18 within the top portion 400.

In various embodiments, the top transition region 300 defines a gradual radius of curvature between the vertical portions of the sidewalls 11-18 in the vertical portion 200 and the planar, non-vertical portions of the sidewalls 11-18 within the top portion 400. As a non-limiting example, the top transition region 300 has a radius of curvature of at least about 2.6-2.65 inches (e.g., 2.625 inches). In various embodiments, the top transition region 300 has a height (measured vertically between beginning of the radius of curvature at the top edge of the vertical portion 200 and the ending of the radius of curvature at the lower-most edge of the top portion 400 of 2.25-2.29 inches (e.g., 2.27 inches). Moreover, the top portion may extend at an angle with respect to horizontal of at least approximately 30-35 degrees. This gradual radius of curvature of the top transition region 300 over the height of the top transition region 300 facilitates movement of container material across the top transition region 300 between the top portion 400 and the vertical portion 200 during formation of the container 1 in order to provide an at least substantially uniform wall thickness across all of the top portion 400, the top transition region 300, the vertical portion 200 and the base portion 100.

In various embodiments, the top transition region 300 has a continuous gradual radius of curvature along the entire height of the top transition region 300. However, it should be understood that the radius of curvature of the top transition region 300 may vary (e.g., linearly increase and/or linearly decrease) over the height of the top transition region 300. Moreover, in various embodiments, the top transition region 300 may have a single radius of curvature configuration (either continuous or variable) applicable for all of the sidewalls 11-18. However, in various embodiments, one or more sidewalls may have different radius of curvature configurations. For example, the top transition region 300 may define a first radius of curvature configuration corresponding to one or more of the short sidewalls 15-18 and a second radius of curvature configuration corresponding to one or more long sidewalls 11-14.

Moreover, as discussed herein, one or more grooves 221-223 may extend into the top transition region 300. Accordingly, the portion of the one or more grooves 221-223 positioned within the top transition region 300 may define one or more complex curves having radii of curvature extending in a plurality of directions (e.g., an inner radius of curvature of a groove may follow the radius of curvature of the top transition region 300).

In certain embodiments, the width of each of the plurality of sidewalls 11-18 may vary over the height of the top transition region 300. For example, each of the plurality of sidewalls may have a first width corresponding to the width of the sidewalls 11-18 in the vertical portion 200 at a bottom edge of the top transition region 300, and a second width at a top edge of the top transition region 300. In certain embodiments, the second width of the sidewalls 11-18 may be narrower than the corresponding first widths of the sidewalls 11-18. Accordingly, the one or more sidewalls 11-18 may begin to converge toward a center portion of the container 1 (e.g., toward the spout 500) across the height of the top transition region 300.

Moreover, as will be discussed in greater detail herein, at least a portion of the top transition region 300 may be interrupted by the handle portion 600. For example, portions of the top transition region 300 corresponding to two long sidewalls 11-12 and an included short sidewall 15 may be interrupted by the handle portion 600. Accordingly, the top transition region 300 may extend partially around the perimeter of the container 1 to correspond to three short sidewalls 16-18 and two long sidewalls 13-14.

Top Portion 400

In the illustrated embodiment of FIGS. 1-8, the top portion 400 may be defined between the top transition region 300 and the spout 500. The top portion 400 may comprise one or more planar portions of the one or more sidewalls 11-18. In the illustrated embodiment of FIGS. 1-8, the sidewalls 11-18 may converge and slope upward toward the spout of the container 1 along the length of the top portion 400 (e.g., between the lowermost edge of the top portion 400, defined by the boundary with the top transition region 300, and the spout). Accordingly, the sidewalls 11-18 may narrow along the length of the top portion 400 from the second width (as discussed above in reference to the top transition region 300) to a third width where the sidewalls 11-18 intersect the spout 500. The third width may be narrower than the second width for each of the sidewalls 11-18.

In various embodiments, the planar portions of the sidewalls 11-18 within the top portion 400 may be neither vertical nor horizontal, and may extend away from the spout 500 at a downward sloping angle relative to horizontal of at least about 30-35 degrees.

Moreover, in the illustrated embodiment of FIGS. 1-8, the top portion 400 defines a top strength protrusion 450 configured to provide crush resistance for the container. The top strength protrusion 450 may comprise an upper surface 451 positioned a distance away from the planar portion of the one or more sidewalls 11-18, and a strength protrusion sidewall 452 connecting the upper surface 451 with the planar portion of the one or more sidewalls 11-18. In various embodiments, the sidewall 452 may have an at least substantially uniform height (measured between the upper surface 451 and the planar portion of the one or more sidewalls 11-18) around the entire perimeter of the top strength protrusion 450. In such embodiments, at least a portion of the upper surface 451 of the top strength protrusion 450 may be at least substantially parallel with a portion of one or more sidewalls 11-18. However, in certain embodiments, the strength protrusion sidewall 452 may have a variable height around the perimeter of the top strength protrusion 450, and in such embodiments, the upper surface 451 of the top strength protrusion 450 may be skewed relative to the planar portion of the one or more sidewalls 11-18. In various embodiments, the upper surface 451 of the top strength protrusion 450 may extend toward the spout 500 at an angle relative to vertical of at least about 20-35 degrees.

In the illustrated embodiment of FIGS. 1-8, the top strength protrusion 450 may extend away from the spout 500 along the top portion 400 and toward the top transition region 300. In various embodiments, the top strength protrusion 450 may entirely surround the spout 500, such that the planar portions of the sidewalls 11-18 intersect the top strength protrusion 450 and do not extend to the spout 500. In various embodiments, the top strength protrusion 450 defines one or more elongated portions between one or more short portions. The one or more elongated portions extend farther away from the spout 500 (along the top portion 400) than the short portions. For example, the one or more elongated portions may extend along one or more short sidewalls 15-18, and the one or more short portions may traverse one or more long sidewalls 11-14. The one or more elongated portions of the top strength protrusion 450 may extend along the top portion 400 between a lower curved end and the spout. The lower curved end may define a radius of curvature of at least about 0.4-0.6 inches (e.g., 0.5 inches). As mentioned, the elongated portions may be separated by one or more short portions. Each of these short portions may define a radius of curvature (in an opposite direction from the lower curved end of the elongated portions) of at least about 0.6-0.65 inches (e.g., 0.625 inches). Accordingly, in various embodiments, the lower edge of the top strength protrusion 450 may follow an at least substantially sinusoidal curve between elongated portions and short portions around at least a portion of the perimeter of the top strength protrusion 450.

As discussed in greater detail herein, the top portion 400 may be interrupted by the handle portion 600. As previously mentioned, the handle portion 600 may occupy a portion of two long sidewalls 11-12 and an included short sidewall 15 positioned between the two long sidewalls 11-12. In such embodiments, the top portion 400 may extend partially around the perimeter of the container 1 between opposite sides of the handle portion 600. Moreover, in such embodiments, the top strength protrusion 450 may define a short portion extending along the sidewalls 11-12, 15 occupied by the handle portion 600. For example, the top strength protrusion 450 may define three elongated portions extending on corresponding short sidewalls 16-18, and separated by two short portions traversing corresponding long sidewalls 13-14 and a third short portion traversing the sidewalls 11-12, 15 occupied by the handle portion 600.

Spout 500

In various embodiments, the spout 500 extends above the top portion 400, and forms an opening from which the contents of the container 1 may be added to the container and/or removed from the container 1. The spout 500 may define a raised shoulder 501 surrounding the spout 500 and intersecting the top portion 400 (e.g., intersecting the top strength protrusions 450). The raised shoulder 501 may extend between the top portion 400 and a neck 502 extending at least substantially vertically from the raised shoulder 501. The neck 502 may define a plurality of protrusions 503 thereon and spaced equally around the perimeter of the neck 502. The neck may extend upward to a cap engagement portion 504 defining one or more threads, nipples, and/or the like to engage a removable cap (not shown) such that the removable cap may be selectably secured to the container 1. In various embodiments, one or more portions of the spout 500 may have a wall thickness greater than the wall thickness of remaining portions of the container 1. Particularly in embodiments comprising a threaded cap engagement portion 504, the cap engagement portion 504 may not be symmetrical across the container symmetry plane A.

Moreover, in certain embodiments, the spout 500 may be configured to provide additional rigidity to the container 1 while a cap is secured thereto. Accordingly, the container 1 may have a higher crush resistance strength while the cap is secured relative to the spout.

In various embodiments, the spout 500 may be located at least substantially centrally with respect to the profile of the container 1. As shown in FIG. 7, the spout 500 may be centrally located relative to the container 1, such that a centerline of the spout 500 is at least substantially aligned with a centerline of the container 1 and a centerline of the base portion 100. Accordingly, the spout 500 may be spaced at least substantially equally from vertical portions of opposite pairs of sidewalls 11-18 (and accordingly opposing portions of the perimeter of the base portion 100) of the container 1.

Handle Portion 600

As mentioned herein, the container 1 may additionally comprise a handle portion 600. In the illustrated embodiment of FIGS. 1-8, the handle portion 600 occupies a portion of container corresponding to two long sidewalls 11-12 and one short sidewall 15 included between the two long sidewalls 11-12. As discussed herein, the handle portion 600 may extend from a lower handle portion positioned within the vertical portion 200 to an upper handle portion positioned within the top portion 400. In various embodiments, at least a portion of the perimeter of the handle portion 600 may align with one or more of the vertical transitions. For example, outer edges of the upper handle portion may align with the vertical transitions existing between the included long sidewalls 11-12 and adjacent short sidewalls 16, 18 positioned outside of the handle portion 600 and within the top portion 400 and at least a portion of the top transition region 300. As shown in the illustrated embodiment of FIGS. 1-8, the outer edges of the handle portion 600 may converge toward the included short sidewall 15 across a portion of the width of the long sidewalls 11-12 through a converging portion between the upper handle portion and the lower handle portion. The outer edges of the handle portion 600 may converge toward the lower handle portion at an angle with respect to vertical of at least about 15-25 degrees (e.g., 21 degrees) within the converging portion. Accordingly, at least a portion of the handle portion 600 may be within a plane that is neither parallel nor perpendicular to the planes of any of the sidewalls 11-18 such that the handle portion 600 defines a handle cavity inset relative to the sidewalls 11-18. The lower handle portion, defining the bottom most edge of the handle portion 600 may extend between opposing converging portions of the outer edge of the handle portion 600 and across the included short sidewall 15. In various embodiments, substantially the entire outer edge of the handle portion 600 may define a transition edge to adjacent portions of the container 1. The transition edge of the handle portion 600 may define a radius of curvature between the handle portion 600 and adjacent portions of the container 1 of between about 0.29 inches to 0.50 inches. In various embodiments, the radius of curvature between the handle portion 600 and the adjacent portions of the container 1 may vary along the edge of the handle portion 600. However, it should be understood that in certain embodiments, the radius of curvature between the handle portion 600 and the adjacent portions of the container 1 may be continuous.

Within the outer edge of the handle portion 600, the handle portion 600 defines a cavity surface 601 and a handle 610. The cavity surface 601 may define a portion of the handle cavity, and may comprise an at least substantially planar inset upper cavity surface portion extending across the included sidewalls 11-12, 15. The inset upper cavity surface portion may intersect a lower cavity surface portion extending substantially outward from the upper cavity surface portion and toward the included short sidewall 15.

Collectively, the inset upper cavity surface portion and the lower cavity surface portion may define a cavity interrupting the included long sidewalls 11-12 and short sidewall 15. In various embodiments, the inset upper cavity surface portion may extend between the upper handle portion toward the lower cavity surface portion at an angle corresponding to the angle of the converging portion of the outer edge of the handle portion 600, and accordingly, the upper cavity surface portion may have an angle with respect to vertical of at least about 14-17 degrees (e.g., 15.5 degrees). In various embodiments, the upper cavity surface portion may slope toward edges of the handle portion 600. For example, the upper cavity surface may slope away from the handle aperture at an angle of at least about 17.5 degrees.

The lower cavity surface portion may be at least substantially horizontal. However, in various embodiments, the lower cavity surface portion may diverge away from the inset upper cavity surface portion and toward the included long sidewalls 11-12. For example, the inset upper cavity surface portion and the lower cavity surface portion may form an obtuse angle therebetween. As a non-limiting example, at least a portion of the inset upper cavity surface portion may be at least substantially perpendicular to the lower cavity surface portion.

In various embodiments, the handle 610 may be aligned with a vertical centerline of the included short sidewall 15. The handle 610 may define a lower handle portion and an upper handle portion. The lower handle portion may extend away from the planar portion of the included short sidewall 15 within the vertical portion 200 and may converge toward the spout at an angle with respect to vertical of at least approximately 10-14 degrees (e.g., 12 degrees), while remaining aligned with the centerline of the included short sidewall 15 and, in various embodiments, the container symmetry plane A. The lower handle portion may have a length of at least approximately 3.5-3.7 inches (e.g., 3.6 inches). The upper handle portion, which may extend between the spout 500 and/or the top strength protrusion 450 and the lower handle portion, may extend at an angle with respect to horizontal of at least approximately 15-25 degrees (e.g., 20 degrees). Moreover, the transition region between the lower handle portion and the upper handle portion may have a radius of curvature of at least approximately 0.9-1.0 inches (e.g., 0.93 inches).

Figure 9:
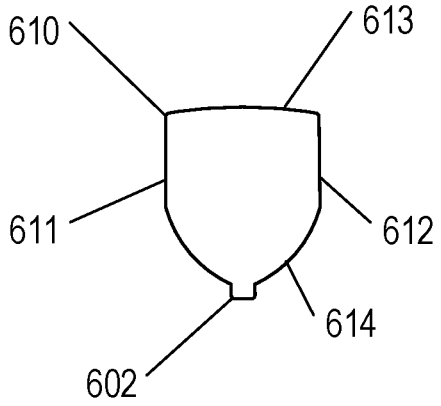
FIG. 9 shows a cross-sectional view of a handle according to various embodiments.

With reference briefly to FIG. 9, which shows a cross section of the handle 610, the handle 610 may be hollow and may have a wall thickness of at least about 0.015-0.019 inches (e.g., 0.017 inches). The cross-section of the handle may have a substantially acorn shape, having a curved outer surface 613, a curved inner surface 614, opposing sidewalls 611, 612 extending between the curved outer surface 613 and the curved inner surface 614. In various embodiments, the curved outer surface 613 may have a width (measured between the outermost edges of the opposing sidewalls 611, 612) of at least approximately 0.6-0.7 inches (e.g., 0.66 inches), and a radius of curvature of at least approximately 0.45-0.49 inches (e.g., 0.47 inches). The curved inner surface 614 may have a width (measured between the innermost edges of the opposing sidewalls 611, 612) of at least approximately 0.6-0.7 inches (e.g., 0.66 inches), and a radius of curvature of at least approximately 0.285-0.32 inches. In various embodiments, the handle 610 may have an at least substantially uniform cross section along the length of the handle (e.g., along the length of the lower portion of the handle and/or the upper portion of the handle). In various embodiments, the lower end of the handle 610, at a location where the handle 610 intersects the lower cavity surface, defines a gradual, curved transition between the handle 610 and the lower cavity surface. For example, the curved transition between the handle 610 and the lower cavity surface may have a radius of curvature of between about 0.29 inches and 0.50 inches. In various embodiments, the radius of curvature between the handle 610 and the lower cavity surface may vary, however, it should be understood that in certain embodiments, the radius of curvature between the handle 610 and the lower cavity surface may be continuous. Similarly, the upper end of the handle 610, at a location where the handle 610 intersects the inset upper cavity surface, defines a gradual, curved transition between the handle 610 and the inset upper cavity surface. For example, the curved transition between the handle 610 and the inset upper cavity surface may have a radius of curvature of between about 0.375 inches and 0.50 inches. In various embodiments, the radius of curvature between the handle 610 and the inset upper cavity surface may vary, however, it should be understood that in certain embodiments, the radius of curvature between the handle 610 and the inset upper cavity surface may be continuous.

Collectively, the handle 610 and the cavity surface 610 may define an aperture extending therebetween and configured to permit a user's hand to grasp the handle 610. In the illustrated embodiment of FIGS. 1-8, the aperture may be an at least substantially oblong aperture, and may have a height of at least approximately 2.746-2.758 inches, and/or a width of at least approximately 0.5-0.6 inches (e.g., 0.54 inches). Moreover, the aperture may have an upper curved end having a radius of curvature of at least substantially 0.35-0.4 inches (e.g., 0.375 inches) and a lower curved end having a radius of curvature of at least about 0.2-0.4 inches (e.g., 0.30 inches). Accordingly, the aperture may be configured to accept one or more human fingers therein while a user is grasping the handle 610.

In the illustrated embodiment of FIGS. 1-8, the aperture of the handle portion 600 is lined with a handle rib 602 extending along the curved inner surface 614 of the handle 610, along the lower cavity surface and along the inset upper cavity surface. The handle rib 602 may define a substantially trapezoidal shape, having opposing sidewalls extending between the curved inner surface of the handle 610 or the cavity surface 601 and a curved inner rib surface. The curved inner rib surface may have a width of at least approximately 0.16-0.17 inches (e.g., 0.165 inches) and a radius of curvature of at least approximately 0.3-0.4 inches (e.g., 0.035 inches). In various embodiments, the handle rib 602 may extend away from the curved inner surface of the handle 610 and the cavity surface 601 by a distance of at least approximately 0.02-0.03 inches (e.g., 0.025 inches). In various embodiments, the handle rib 602 and handle 610 may be aligned with the container symmetry plane A. The handle rib 602 may be configured to add rigidity to the handle 610 in order to provide additional strength against breakage of the container 1 when in use.

In various embodiments, the handle portion 600 may have a rough surface texture in order to provide additional rigidity against undesired flexing of the handle portion 600 during use. In various embodiments, the rough surface texture may extend between the outer edges of the handle portion 600 and around the entirety of the handle 610. In various embodiments, the rough surface texture may extend along the included short sidewall 615-618 within the vertical portion 200 (e.g., to a bottom edge of the vertical portion 200).

Method of Manufacture

Figure 10A:
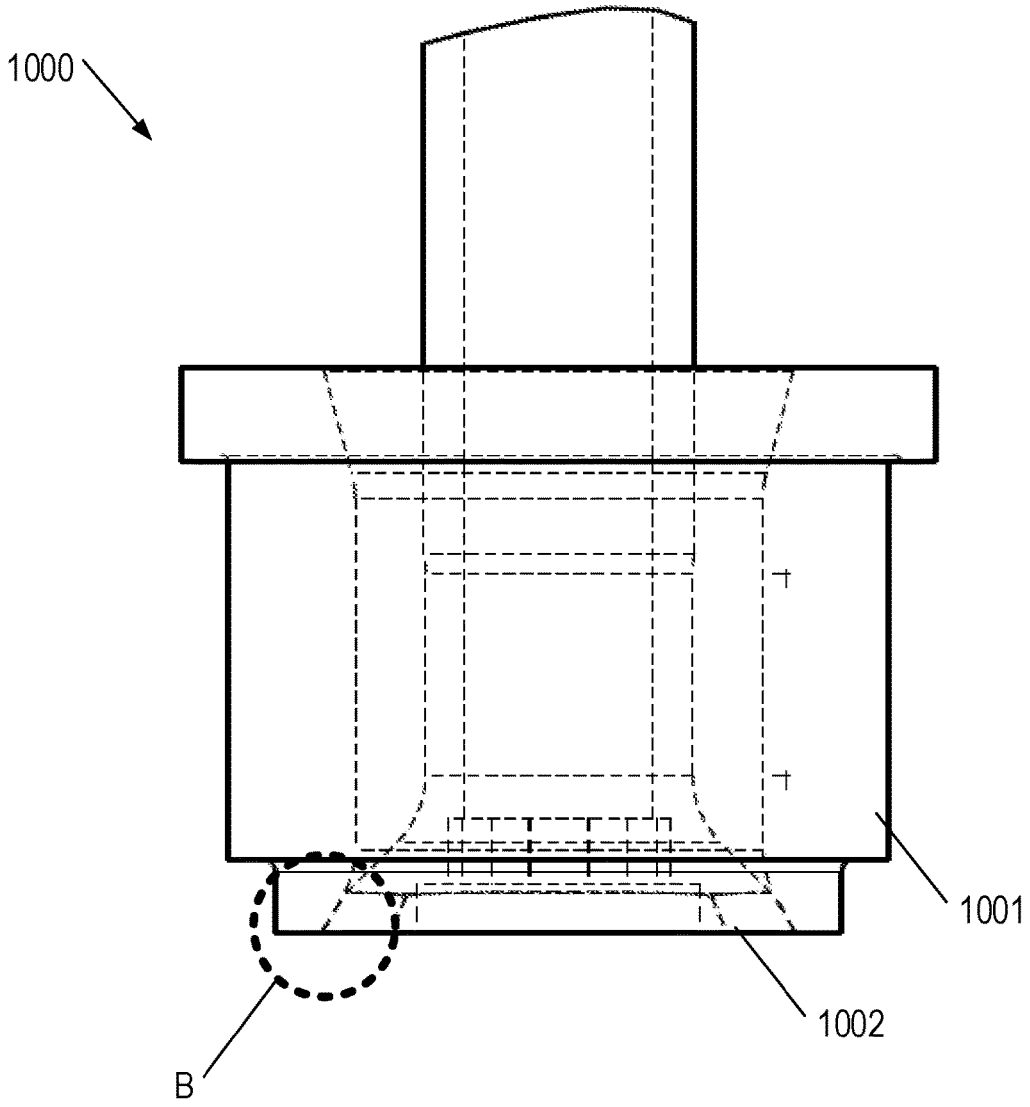
FIGS. 10A-10B show various aspects of a head tool utilized in generating a container according to various embodiments.
Figure 10B:
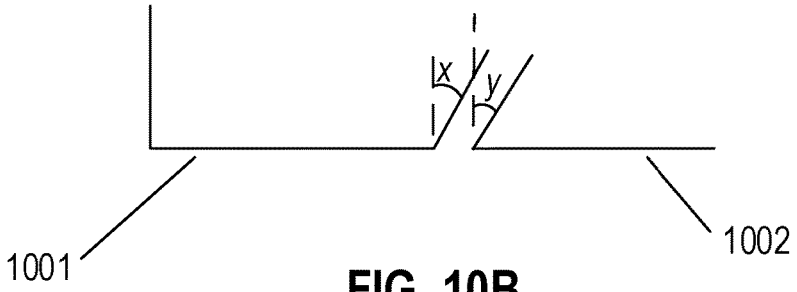

As mentioned, a container according to various embodiments may be manufactured via extrusion blowmolding. Accordingly, a parison of molten plastic may be placed within a mold, secured relative to a head tool 1000 (as shown in FIGS. 10A-10B). As shown in the illustrated embodiments of FIGS. 10A-10B, the head tool 1000 may comprise a die 1001 and a mandrel 1002 positioned within the die 1001. In the illustrated embodiment of FIGS. 10A-10B, the die 1001 may comprise a hollow central aperture within which the mandrel 1002 may be positioned.

As shown in FIG. 10B, the mandrel 1002 is positioned within the die 1001 and spaced apart therefrom. The mandrel 1002 may be concentric with the die 1001, and may have a smaller out diameter than the inner diameter of the die 1001. Accordingly, the mandrel 1002 may be spaced a distance from the die 1001. For example, the mandrel 1002 may be spaced at least about 0.005 inches from the die 1001. Moreover, as shown in FIG. 10B, the interior surface of the die 1001 may form an angle x with respect to vertical. Similarly, the exterior surface of the mandrel 1002 may form an angle y with respect to vertical. In various embodiments, x and y may be equal, however in certain embodiments, x and y are not equal. As a non-limiting example, x may be at least about 30 degrees and y may be at least about 32 degrees.

The parison may be placed within the mold by injecting the molten plastic material through the gap formed between the die 1001 and the mandrel 1002. Once sufficient material is positioned within the mold (e.g., 52-72 g for a one-gallon container 1), the parison may be inflated by injecting air through the center of the mandrel 1002, causing the parison to inflate and contour to the interior shape of the mold. The mold may have a shape corresponding to the shape of the container 1. As discussed herein, various portions of the container 1, such as the top transition region 300, may be configured to facilitate molten material flow within the mold to enable generation of a container 1 with an at least substantially uniform wall thickness.

After inflating the parison to conform to the interior surface of the mold, the molten material may cool and harden to form the container 1. After the container has sufficiently hardened, the mold may be opened (e.g., by displacing two symmetrical mold halves away from one another (e.g., joining at a portion aligned at least substantially with the container symmetry plane A)). The container 1 may be removed from the mold and/or head tool 1000.

CONCLUSION

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. A container comprising:

a base portion configured to support the container in an upright orientation relative to a support surface and wherein the base portion defines an at least substantially octagonal perimeter;

a spout positioned opposite the base portion;

a plurality of alternating long sidewalls and short sidewalls extending between the perimeter of the base portion and the spout and having curved vertical transitions joining adjacent sidewalls, wherein the curved vertical transitions extend between the base portion and the spout, the plurality of alternating long sidewalls and short sidewalls collectively defining:

a vertical portion extending away from the base portion;

a downward sloping planar top portion extending away from the spout and toward the vertical portion; and a gradually curved transition region extending between the vertical portion and the downward sloping planar top portion; and a handle portion positioned at least partially within the downward sloping planar top portion and the gradually curved transition region, wherein the handle portion comprises:

a cavity surface extending across a plurality of sidewalls;

a hollow handle extending between a top portion and a bottom portion of the cavity surface, wherein the handle defines an acorn-shaped cross-section along at least a portion of a length of the handle; and a handle rib protrusion extending continuously along an inner surface of the hollow handle and along the cavity surface, wherein the handle rib protrusion is aligned with a centerline of the hollow handle and extends parallel to the hollow handle; and wherein a first portion of an edge of the handle portion is aligned with at least one of the curved vertical transitions within the downward sloping planar top portion and a second portion of the edge of the handle portion defines a linear converging portion extending from the first portion and toward a lower end of the hollow handle within the vertical portion of a sidewall of the plurality of alternating long sidewalls and short sidewalls.

2. The container of claim 1, wherein each of the plurality of long sidewalls and short sidewalls defines an at least substantially uniform wall thickness through the vertical portion, transition region, and downward sloping planar top portion.

3. The container of claim 1, wherein the plurality of alternating long sidewalls and short sidewalls additionally define a curved base transition region extending between the base portion and the vertical portion, wherein the curved base transition region encompasses one or more base vertical grooves.

4. The container of claim 1, wherein the container is symmetrical about a container symmetry plane extending through the spout and the base portion and through a first short sidewall and a second short sidewall parallel to the first short sidewall.

5. A high-density polyethylene container comprising:

a base portion configured to support the container in an upright orientation relative to a support surface and wherein the base portion defines an at least substantially octagonal perimeter;

a spout positioned opposite the base portion and oriented such that a centerline of the spout is aligned with a centerline of the base portion;

a plurality of sidewalls extending between the perimeter of the base portion and the spout, wherein the plurality of sidewalls define:

a vertical portion extending away from the base portion; and a downward sloping planar top portion extending away from the spout and toward the vertical portion; and a cap detachably secured relative to the spout to entirely enclose an interior of the container;

wherein the plurality of sidewalls have an at least substantially uniform wall thickness of at least approximately 0.007-0.011 inches; and wherein the container is configured to resist a vertical crushing force of at least approximately 30 lbf of force with about a ¼" deflection in overall height of the container when filled.

6. The high-density polyethylene container of claim 5, wherein the plurality of sidewalls collectively define one or more vertical grooves defined within at least one of the sidewalls and extending within the vertical portion and the gradually curved transition region positioned between the vertical portion and the downward sloping planar top portion.

7. The high-density polyethylene container of claim 5, wherein the plurality of sidewalls additionally define a curved base transition region extending between the base portion and the vertical portion, wherein the curved base transition region encompasses one or more base vertical grooves.

8. The high-density polyethylene container of claim 5, wherein one or more of the plurality of sidewalls define a handle cavity, and at least a portion of an edge of the handle cavity is aligned with at least one curved vertical transition separating adjacent sidewalls of the plurality of sidewalls.

9. The high-density polyethylene container of claim 5, wherein the container is symmetrical about a container symmetry plane extending through the spout and the base portion and through parallel sidewalls of the plurality of sidewalls.

10. A container comprising:

a base portion configured to support the container in an upright orientation relative to a support surface and wherein the base portion defines an at least substantially octagonal perimeter;

a spout positioned opposite the base portion;

a plurality of sidewalls extending between the perimeter of the base portion and the spout and having curved vertical transitions joining adjacent sidewalls, wherein the curved vertical transitions extend between the base portion and the spout, the plurality of sidewalls collectively defining:

a vertical portion extending away from the base portion;

a downward sloping planar top portion extending away from the spout and toward the vertical portion;

a gradually curved transition region extending between the vertical portion and the downward sloping planar top portion; and one or more vertical grooves defined within at least one of the sidewalls and extending within the vertical portion and the gradually curved transition region.

11. The container of claim 10, wherein each of the plurality of sidewalls defines an at least substantially uniform wall thickness through the vertical portion, transition region, and downward sloping planar top portion.

12. The container of claim 10, wherein the plurality of sidewalls additionally define a curved base transition region extending between the base portion and the vertical portion, wherein the curved base transition region encompasses one or more base vertical grooves.

13. The container of claim 10, wherein the plurality of sidewalls define a handle cavity positioned at least partially within the downward sloping planar top portion and the gradually curved transition region, and wherein at least a portion of an edge of the handle cavity is aligned with at least one of the curved vertical transitions within the downward sloping planar top portion.

14. The container of claim 10, wherein the container is symmetrical about a container symmetry plane extending through the spout and the base portion and through parallel sidewalls of the plurality of sidewalls.

15. A container comprising:

a base portion configured to support the container in an upright orientation relative to a support surface and wherein the base portion defines an at least substantially octagonal perimeter;

a spout positioned opposite the base portion;

a plurality of alternating long sidewalls and short sidewalls extending between the perimeter of the base portion and the spout and having curved vertical transitions joining adjacent sidewalls, wherein the curved vertical transitions extend between the base portion and the spout; and wherein the base portion defines:

a first base channel extending across the base portion between a first short sidewall and a second short sidewall opposite the first short sidewall, wherein the first base channel defines a first depth; and a second base channel extending perpendicular to the first base channel across the base portion between a third short sidewall and a fourth short sidewall opposite the third short sidewall, wherein the second base channel defines a second depth; and wherein the first depth is deeper than the second depth.

16. The container of claim 15, wherein each of the plurality of long sidewalls and short sidewalls defines an at least substantially uniform wall thickness through the vertical portion, transition region, and downward sloping planar top portion.

17. The container of claim 15, wherein the plurality of alternating long sidewalls and short sidewalls additionally define a curved base transition region extending between the base portion and the vertical portion, wherein the curved base transition region encompasses one or more base vertical grooves.

18. The container of claim 15, wherein the plurality of sidewalls define a handle cavity, and wherein at least a portion of an edge of the handle cavity is aligned with at least one of the curved vertical transitions within the downward sloping planar top portion.

19. The container of claim 15, wherein the container is symmetrical about a container symmetry plane extending through the spout and the base portion and through a first short sidewall and a second short sidewall parallel to the first short sidewall.

* * * * *